United States Patent [19]

Albrecht

[11] 4,353,350

[45] Oct. 12, 1982

[54] FIREPLACE HEAT EXCHANGER

[76] Inventor: Helmut Albrecht, 4954 Nettleton Rd., Medina, Ohio 44256

[21] Appl. No.: 242,464

[22] Filed: Mar. 11, 1981

[51] Int. Cl.[3] ..... F24B 7/00

[52] U.S. Cl. ..... 126/121; 165/109 T; 165/175; 237/51

[58] Field of Search ..... 126/121; 237/51; 165/179, 181, 109 T, DIG. 2, 175

[56] References Cited

U.S. PATENT DOCUMENTS

| | | | |
|---|---|---|---|
| 1,852,490 | 4/1932 | Sullivan | 165/109 T |
| 2,343,542 | 3/1944 | Faunce | 165/DIG. 2 |
| 2,882,023 | 4/1959 | Rizzo | 165/DIG. 2 |
| 4,018,209 | 4/1977 | Bonvicini | 126/121 |
| 4,122,824 | 10/1978 | Borgran | 126/121 |

*Primary Examiner*—Ronald C. Capossela

[57] ABSTRACT

A fireplace heat exchanger is disclosed comprising a spacer frame assembly adapted to provide a frame for surrounding the open front of a fireplace opening, and a heat exchanger assembly in communication with said frame assembly. The heat exchanger assembly comprises a pair of laterally-spaced horizontal manifold tubes, and a plurality of horizontally-extending parallel heat exchanger or convection tubes interconnecting said manifold tubes, said convection tubes having opposite sides thereof indented, with the indentations of each tube facing the indentations of adjacent tubes to thereby form substantially circular flues for the escape of smoke vertically therethrough. Means are provided, for removably securing the heat exchanger assembly, at an elevated position to the side walls of the fireplace, and for removably securing the spacer frame assembly to walls surrounding the front of the fireplace. Each of the convection tubes contains a spiral strip or element which is designed to increase the heat transfer area and direct the air in spiral flow extending the time the air is in the tubes.

10 Claims, 16 Drawing Figures

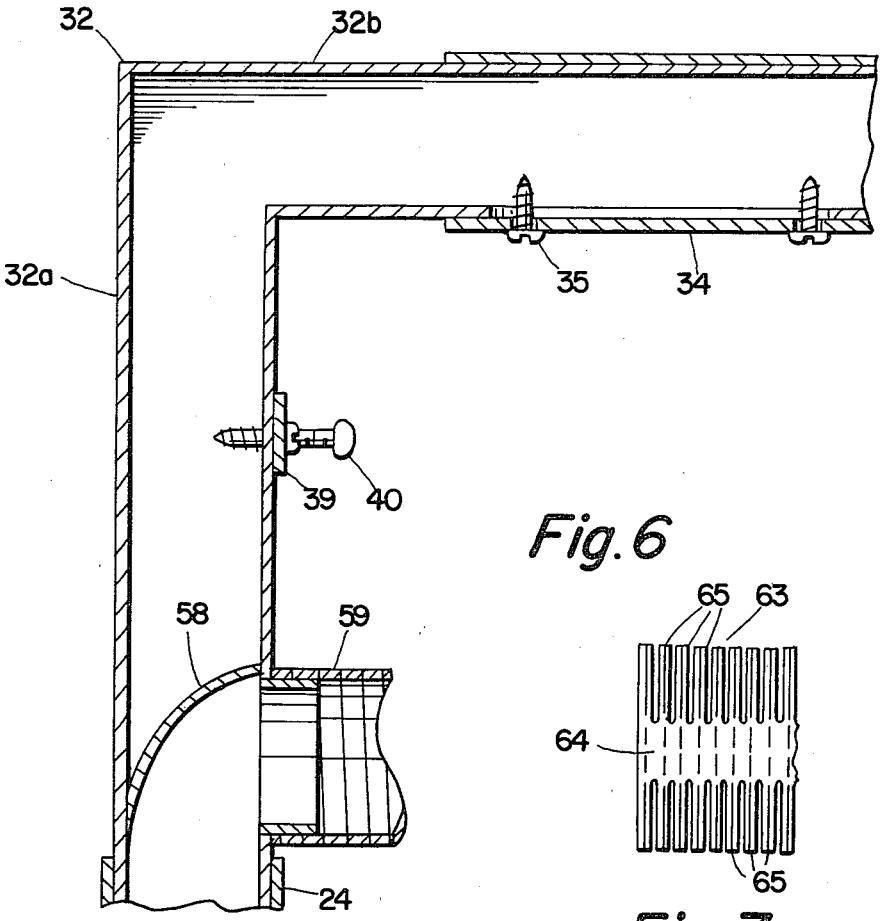
Fig. 6
Fig. 7a
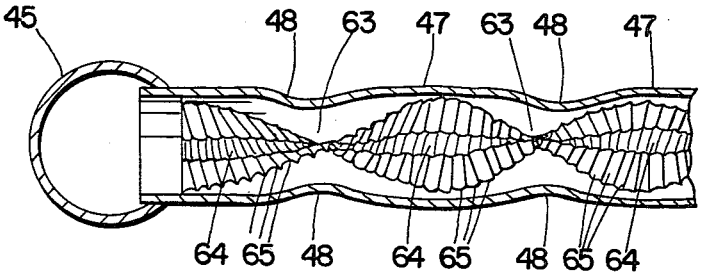
Fig. 7
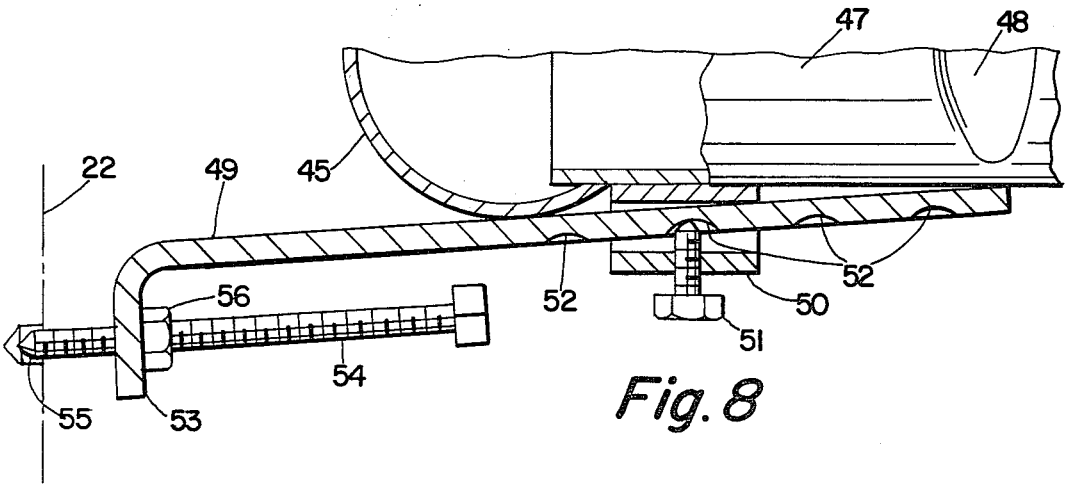
Fig. 8

FIREPLACE HEAT EXCHANGER

This invention relates to a fireplace heat exchanger, but has reference more particularly to a heat exchanger which generates a large volume of heated air for the rooms which are to be heated while making provision for rapid and unobstructed release of smoke from the burning fuel upwardly through the heat exchanger and into the fireplace chimney.

A primary object of the invention is to provide a heat exchanger of the character described, in which heat exchanger tubes are utilized in which tubes spiralled strips containing hundreds of fins are disposed, which strips increase the heat transfer surface area and direct the air in spiral flow, thereby extending the time the air is in the tubes, as a result of which the air captures much more of the available heat than can be absorbed when air flows directly through a hollow tube.

Another object of the invention is to provide a heat exchanger of the character described, which places the heat exchanger tubes away from the hot fuel and flames, and which, combined with the heavy wall thickness of the tubes, prevents scaling and high temperature burn-out and provides efficient, long term operation with no routine maintenance.

A further object of the invention is to provide a heat exchanger of the character described having a spacer frame mounted in front of the fireplace and the heat exchanger assembly above the grate, leaving ready access to the grate, and nothing to move or disassemble for early ash removal.

A still further object of the invention is to provide a heat exchanger of the character described having spacer frame and heat exchanger mounting brackets which are adjustable, whereby a single standard unit can be installed in almost any standard house fireplace in minutes using only normal hand tools.

In my co-pending patent application Ser. No. 193,808 filed Oct. 3, 1980, a fireplace heat exchanger is disclosed, comprising a plurality of horizontally-extending open-ended convection tubes arranged in parallel relation to each other, a plurality of spaced tubular open-ended conduits or flues extending vertically and diametrically through said convection tubes and an envelope or covering enclosing said convection tubes and flues.

The advantage of such a heat exchanger resides in the fact that it can be made from tubing or tubes which are not required to be curved or bent into predetermined shape or form and can thus be manufactured and assembled without the use of complicated and expensive bending apparatus.

Another advantage of such a heat exchanger is that it has ample provision for premitting smoke and particulate matter arising from the burning fuel in the fireplace grate to enter the chimney of the fireplace, as well as to increase the draft for burning the fuel.

A further advantage of such a heat exchanger is that it is highly efficient from the standpoint of heat exchange, whereby a minimum of heat generated by the burning fuel is wasted or lost.

A still further advantage of such a heat exchanger is that it is so located in the fireplace as to impose no interference to maintenance of the fire or cleaning of the fireplace area.

It has been found however, that the manufacture and assembly of the tubes and envelope constituting said fireplace heat exchanger, requires a large number of tubes assembled in predetermined relationship and entailing an expenditure of a great deal of time and labor.

This invention has, as its primary object, the provision of a fireplace heat exchanger of the above-described character, which has all or most of the advantages to which reference has been made, but which is of simpler construction, embodies a minimum number of tubes and other parts, and can be manufactured and assembled at low cost and in less time.

The present invention may be better understood and the numerous objects and advantages thereof will become apparent to those skilled in the art by reference to the accompanying drawings, wherein like reference characters or numerals refer to like elements or parts in the various figures and in which:

FIG. 6 is a fragmentary cross-sectional view taken on the line 6—6 of FIG. 2;

FIG. 7 is a fragmentary cross-sectional view taken on the line 7—7 of FIG. 2;

FIG. 7*a* is a fragmentary plan view of a portion of a finned strip which is used inside of the heat exchanger or convection tubes for purposes to be presently described.

Figure 2:
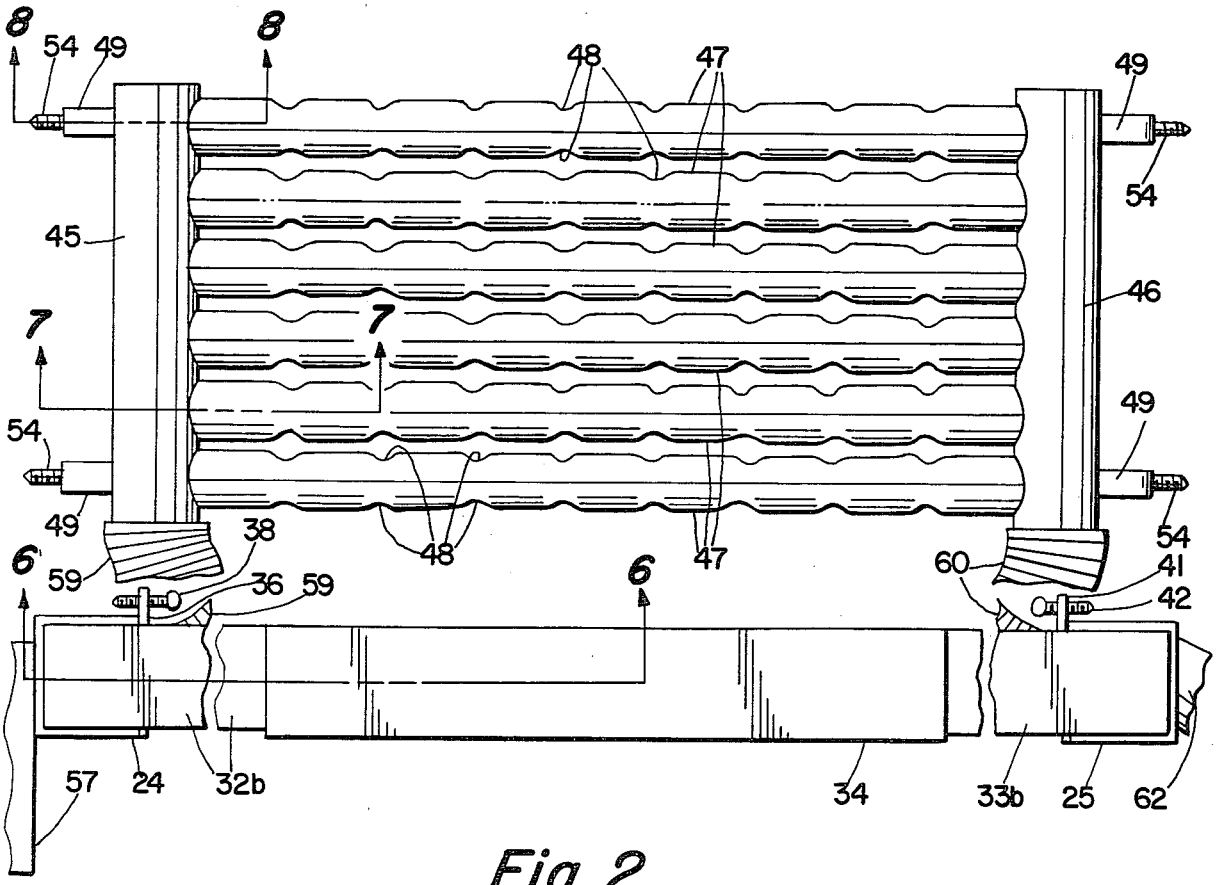
FIG. 2 is a top plan view of the heat exchanger of FIG. 1.
Figure 3:
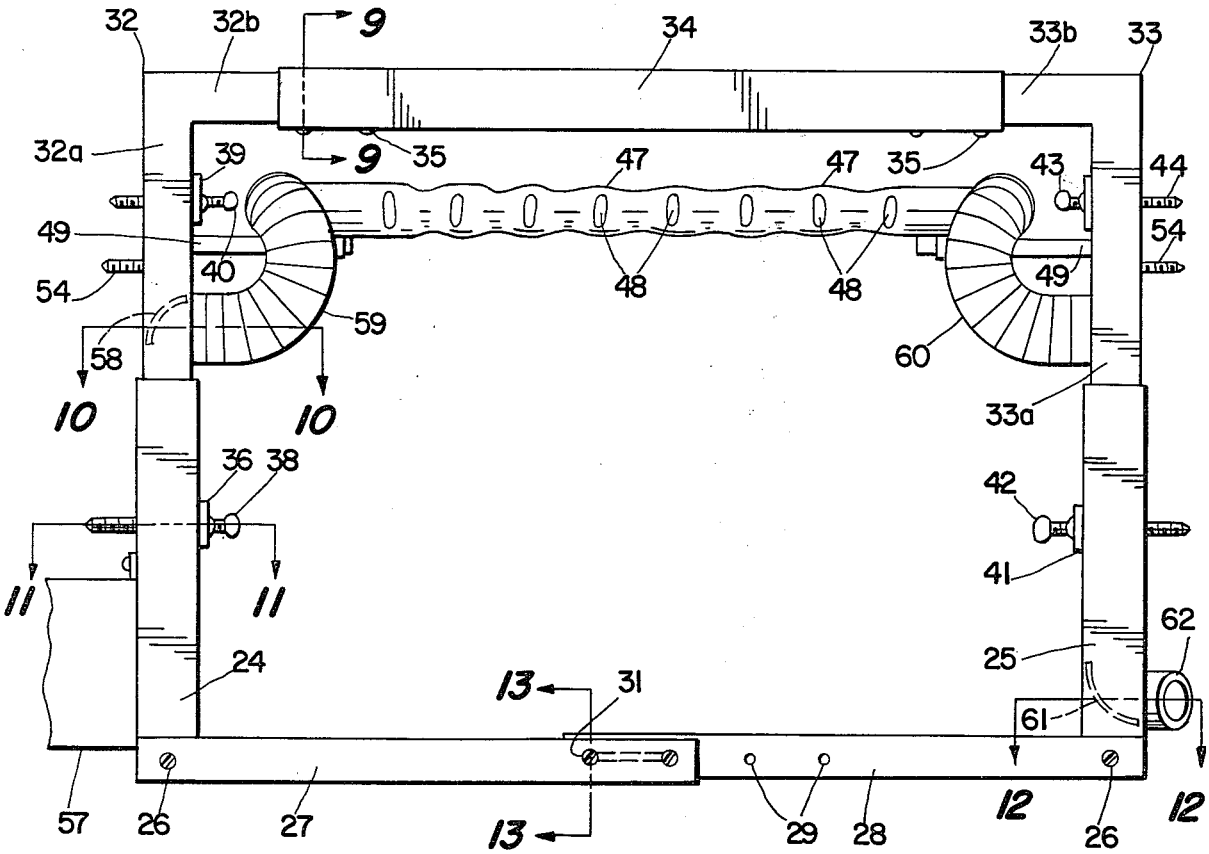
FIG. 3 is a front elevational view of the heat exchanger of FIG. 2.
Figure 4:
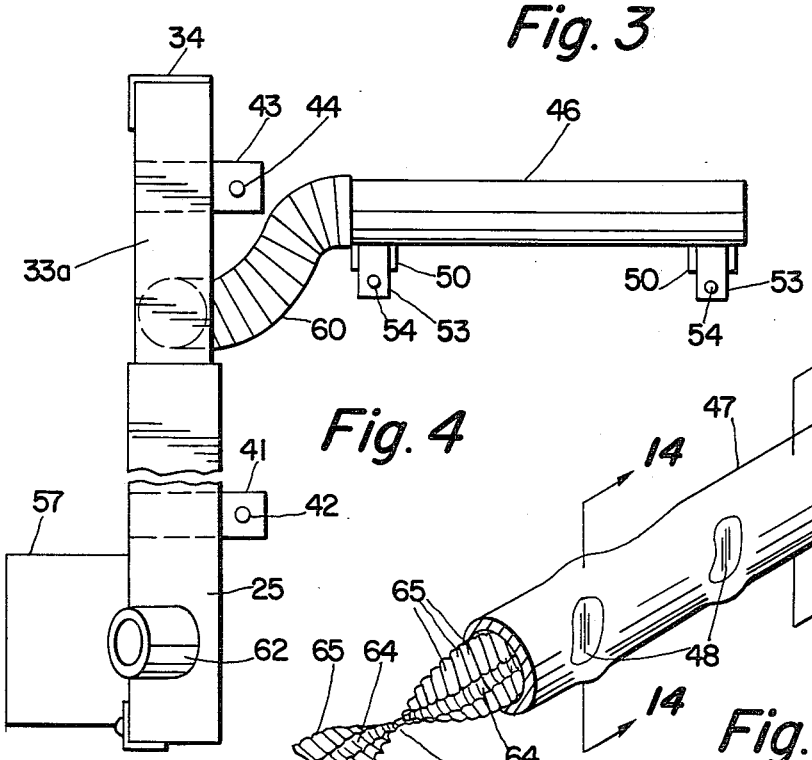
FIG. 4 is a side or end elevational view of the heat exchanger of FIGS. 1, 2 and 3, as viewed from the right side of FIG. 3.
Figure 5:
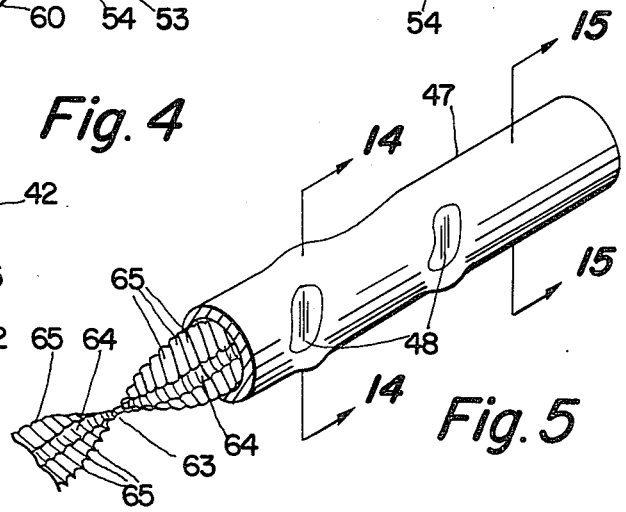
FIG. 5 is a fragmentary isometric view of a portion of one of the heat exchanger or convection tubes of the heat exchanger.
Figure 9:
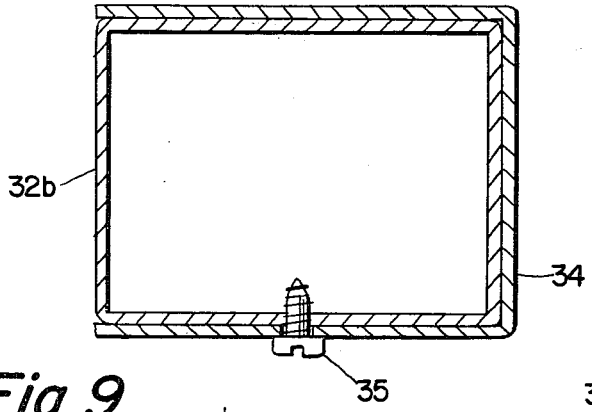
Figure 10:
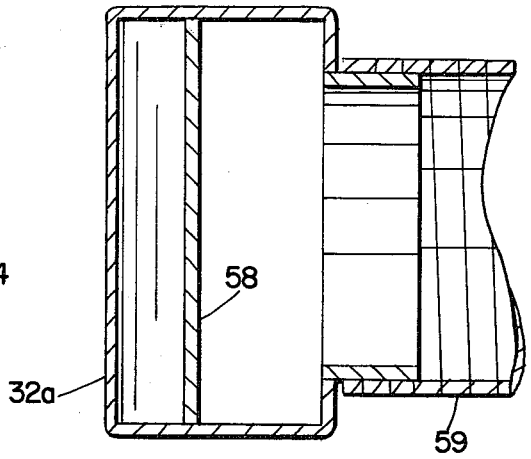
Figure 11:
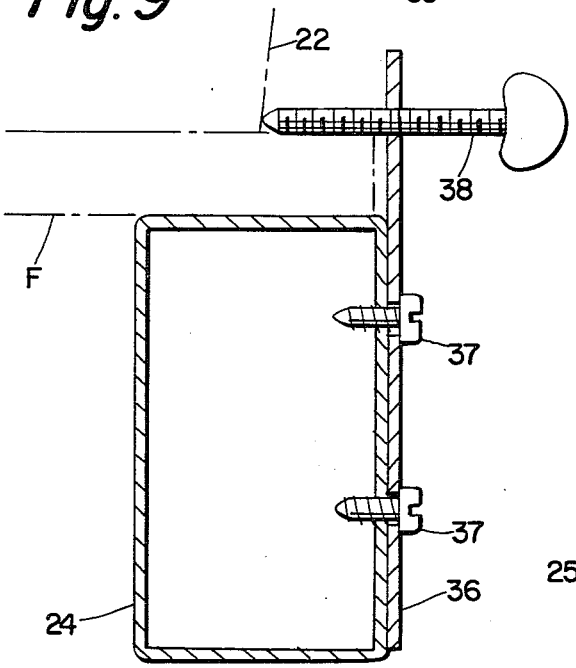
Figure 12:
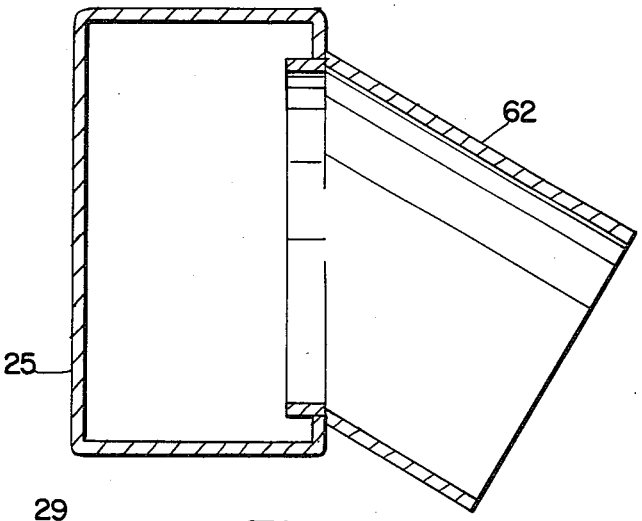
Figure 13:
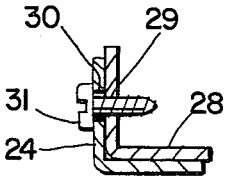
Figure 14:
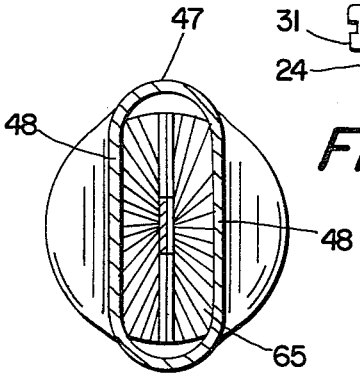
Figure 15:
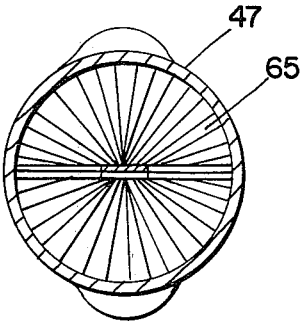

FIG. 8 is a fragmentary cross-sectional view taken on the line 8—8 of FIG. 2;

FIG. 9 is a cross-sectional view taken on the line 9—9 of FIG. 3;

FIG. 10 is a fragmentary cross-sectional view taken on the line 10—10 of FIG. 3;

FIG. 11 is a cross-sectional view taken on the line 11—11 of FIG. 3;

FIG. 12 is a cross-sectional view taken on the line 12—12 of FIG. 3;

FIG. 13 is a cross-sectional view taken on the line 13—13 of FIG. 3;

FIG. 14 is a cross-sectional view taken on the line 14—14 of FIG. 5; and FIG. 15 is a cross-sectional view taken on the line 15—15 of FIG. 5.

Figure 1:
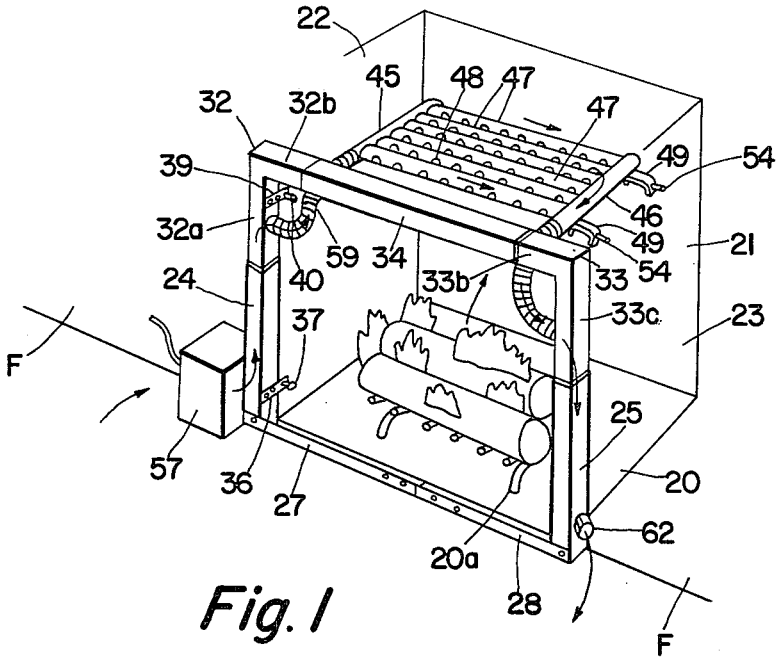
FIG. 1 is an isometric view of a fireplace, in which a heat exchanger embodying the invention is disposed.

Referring more particularly to FIG. 1 of the drawings, a conventional fireplace is shown having a hearth or floor 20, a vertical back wall 21 and converging side walls 22 and 23.

The reference character F in FIGS. 1 and 11 designates a wall usually made of brick, stone or the like, which provides a facing for the wall which surrounds the fireplace and projects inwardly into the fireplace opening, as best seen in FIG. 11.

In this instance, the front of the fireplace is open, but may, if desired, be closed by means of a firescreen, such, for example, as that shown in my aforesaid co-pending application. The firescreen may be one with tempered glass doors, to minimize heat loss and wood consumption, or one utilizing a mesh type firescreen.

The hearth or floor 20 of the fireplace is adapted for the support of a conventional grate 20*a* in which fuel such as logs or coal, is to be burned.

Referring to the drawings generally, the heat exchanger comprises a metallic spacer frame assembly which, as best seen in FIGS. 1, 2, 3, 4, 6, 9, 10, 11, 12 and 13, consists of a pair of upright conduits 24 and 25, of rectangular cross-section, the lower ends of which are secured as by screws 26, to angles 27 and 28 which as seen in FIGS. 3 and 13, are in nested relationship.

In order to accommodate the frame to fireplace openings of different widths, the angle 28 is provided with a plurality of spaced threaded openings 29 and the angle 27 is provided with an opening 30 through which a sheet metal screw 31 extends, and which may be threadedly secured in any one of the openings 29.

The frame assembly further comprises a pair of inverted L-shaped conduits 32 and 33 of rectangular cross-section, the conduit 32 having a vertical component 32*a* which slidably fits within the upper end of the conduit 24, and the conduit 33 having a vertical component 33*a* which slidably fits within the upper end of the conduit 25.

The conduit 32 has a horizontal component 32*b* which slidably fits within one end of a channel member 34 and is secured to said channel member by means of a sheet metal screw 35 (FIG. 9).

The conduit 33 has a horizontal component 33*b* which slidably fits within the other end of the channel member 34, and is secured to said channel member in the same manner that the horizontal component 32*b* is secured to said channel member.

The channel member 34 forms the top of the frame assembly and it is to be understood that when the frame is to be widened to accommodate it to fireplace openings of different widths, the channel member may be provided with a plurality of longitudinally-spaced openings to receive the screws 35.

For the purpose of securing the frame assembly to the fireplace, means such as best illustrated in FIGS. 1, 2, 3, 6 and 11, may be used.

Such means comprises metal plates or clips 36 which are secured to the conduits 24 by means of screws 37 (FIG. 11) the plates extending rearwardly beyond the conduit 24, and the rearward extension being provided with a screw 38. As seen in FIG. 11, the conduit 24 abuts the wall F, which extends into the fireplace opening, and the screw 38 is moved into engagment with the side wall 22 of the fireplace opening to thereby clamp the conduit to the wall F.

In a similar manner, a metal plate or clip 39 is secured to the conduit 32 and extends rearwardly beyond the conduit 32, the rearward extension being provided with a screw 40. The conduit 32 abuts the wall F and the screw 40 is moved into engagement with the side wall 22 of the fireplace opening, to thereby clamp the conduit 32 to the wall F.

In a similar manner, a metal plate or clip 41 is secured to the conduit 25 and extends rearwardly beyond the conduit 25, the rearward extension being provided with a screw 42. The conduit 25 abuts the wall F and the screw 42 is moved into engagement with the side wall 23 of the fireplace opening, to thereby clamp the conduit 25 to the wall F.

Similarly, the metal plate or clip 43 is secured to the conduit 33, and extends rearwardly beyond the conduit 33, the rearward extension being provided with a screw 44. The conduit 33 abuts the wall F and the screw 44 is moved into engagement with the side wall 23 of the fireplace opening, to thereby clamp the conduit 33 to the wall F.

The heat exchanger further includes a pair of laterally-spaced tubular conduits or manifolds 45 and 46, which as best seen in FIGS. 1, 2, 4, 7 and 8 extend horizontally from points spaced rearwardly of the upper portion of the frame to points adjacent the back wall 21 of the fireplace opening.

As best seen in FIGS. 1, 2, 3, 5, 7, 8, 14 and 15, the tubular conduits or manifolds 45 and 46 are interconnected by a series of horizontally-extending, parallel spaced heat exchanger or convection tubes 47 which serve a purpose to be presently described.

Each of the heat exchanger or convection tubes 47 consists of a tube which is indented at longitudinally-spaced points, at the front and rear of the tube to provide a recess or identation 48 which as best seen in FIGS. 2, 3, 5, 7, 8 and 14, is substantially semi-circular contour, so that when the tubes are arranged with the recesses or indentations in face-to-face relation, as in FIG. 2, the recesses or indentation provide vertical, tube-like flues for passage therethrough of smoke upwardly into the chimney.

For the purpose of supporting the conduits or manifolds 45 and 46 and tubes 47 in the fireplace, means which are best seen in FIGS. 1, 2, 3 and 8 are employed.

Such means comprises brackets 49 which extend through collars 50 (FIG. 8), which are welded or otherwise secured to the ends of tubes 47.

The brackets 49 are adjustable longitudinally relatively to the collars 50 and are maintained in adjusted position by means of a lock screw 51 which is threaded in the collar and movable into any selected one of a series of spaced recesses 52 in the bracket 49.

The bracket 49 is provided with a downturned flange 53, in which a screw 54 is mounted. The screw 54 is movable into a recess 55 in the side walls 22 and 23 of the fireplace opening, so that when all four of the screws 54 are thus engaged in the side walls 22 and 23, the heat exchanger will be firmly and rigidly supported in the fireplace.

The screws 54 are locked in adjusted position by means of lock nuts 56 which are mounted on the screws and movable against the flanges 53 of the brackets 49.

The cold air which is to be heated is introduced into the heat exchanger by a blower motor (not shown) which is housed in a housing 57 which is secured to the conduit 24 adjacent the lower end of this conduit.

This air is blown into the conduit 24, passes upwardly into the conduit 32*a*, and is deflected by a deflector 58 in the conduit 32*a* (see FIGS. 3 and 6) into a flexible metallic conduit 59, from which it enters the forward end of the manifold 45, and then passes into and through the tubes 47 in which the air is heated by the burning fuel in the grate 20*a*.

The heated air passes into and through the manifold 46, and enters a flexible metallic conduit 60, one end of which is connected to the forward end of the manifold 46, and the other end of which is connected to the conduit 33*a*. The heated air then passes into the conduit 25 and is deflected by a deflector 61 in the conduit 25 (see FIG. 3), and through an outlet tube 62 into the room which is being heated.

In FIG. 7*a* of the drawings, a fragmentary plan view of a portion of a finned metallic strip 63 is shown comprising a central or median embossed portion 64, and rows of spaced corrugations or fins 65 in parallel relation, extending outwardly in opposite directions from the central portion or median portion 64.

Lengths of such strip 63 are twisted about the portion 64 into spiral form and inserted in the heat exchanger or convection tubes 47 in the manner shown in FIGS. 5, 7, 14 and 15, extending from end to end of each tube.

These spiralled strips containing hundreds of fins inside the heat exchanger or convection tubes provide two advantages; they increase the heat transfer surface area and direct the air in spiral flow extending the time the air is in the tubes. As a result, the air captures much more of the available heat than can be absorbed when air flows directly through a hollow tube.

The heat exchanger, as thus described, fulfills all of the stated objects and advantages of the invention, but it is to be clearly understood that this description is made only by way of example and not as a limitation to the scope of the invention.

The heat exchanger which has been described is capable of transferring heat at the rate of 2000 BTU per minute or 120,000 BTU per hour.

It is adjustable to fit fireplace openings from 27¾" to 44½" wide, and from 26⅛" to 32⅛" in height.

It is adjustable to fit standard brass and glass door sets from 36 to 44 inches wide and 28½ to 32½ inches high.

The unit is equipped with a 100 cubic feet per minute forced air fan.

The exchanger is manufactured from 0.065" heavy tubing and can produce hot air at the outlet at 200° F. to 700° F., depending upon the size of the fire in the fireplace.

The heat exchanger does not have to be removed in order to clean ashes and there is no interference with the use of the ash pit.

Having thus described my invention, I claim:

1. In a fireplace heat exchanger of the character described, a spacer frame assembly adapted to provide a frame for surrounding the open front of a fireplace opening and a heat exchanger assembly in communication with said side frame assembly, said heat exchanger assembly comprising a pair of laterally-spaced horizontal manifold tubes, and a plurality of horizontally-extending parallel heat exchanger or convection tubes interconnecting said manifold tubes, said convection tubes having opposite sides thereof indented, with the indentations of each tube facing the indentations of adjacent tubes to thereby form substantially circular flues for the escape of smoke vertically therethrough.

2. A fireplace heat exchanger, as defined in claim 1, wherein said frame assembly is connected to said manifold tubes by means of flexible metallic conduits.

3. A fireplace heat exchanger, as defined in claim 2, including a blower for blowing air to be heated into one of said manifold tubes.

4. A fireplace heat exchanger, as defined in claim 3, including outlet means for passing the heated air into the room which is to be heated.

5. A fireplace heat exchanger, as defined in claim 1, including means for clamping said spacer frame assembly to wall portions embracing the entrance to the front of said fireplace.

6. A fireplace heat exchanger, as defined in claim 1, including means for supporting said heat exchanger assembly on the side walls of said fireplace opening, and at a level adjacent the upper end of the fireplace.

7. A heat exchanger assembly comprising a pair of laterally-spaced horizontal manifold tubes and a plurality of horizontally-extending parallel heat exchanger or convection tubes interconnecting said manifold tubes, said convection tubes having opposite sides thereof indented, with the indentations of each tube facing the indentations of adjacent tubes, to thereby form substantially circular flues for the escape of smoke vertically therethrough.

8. A heat exchanger assembly, as defined in claim 7, wherein said convection tubes contain spiral strips having fins extending to the walls of said convection tubes.

9. A heat exchanger assembly, as defined in claim 8, wherein said strips have embossed median portions, and said fins extend from said median portion and are spaced from each other.

10. A heat exchanger assembly, as defined in claim 9, wherein said fins are of V-shaped cross-section.

* * * * *